United States Patent [19]

Mitchell

[11] 4,407,687

[45] Oct. 4, 1983

[54] METHOD OF MANUFACTURING COVER FOR STIRRUP OF PHYSICIAN'S EXAMINATION TABLE

[76] Inventor: Winalee G. Mitchell, 110 Secor Woods La., Perrysburg, Ohio 43551

[21] Appl. No.: 400,535

[22] Filed: Jul. 21, 1982

Related U.S. Application Data

[62] Division of Ser. No. 159,974, Jun. 16, 1980, Pat. No. 4,360,193.

[51] Int. Cl.[3] ..... B31F 23/10

[52] U.S. Cl. ..... 156/227; 5/444; 128/361; 156/250; 156/324; 269/328

[58] Field of Search ..... 156/290, 227, 226, 272.6, 156/250, 324; 128/361, 149; 54/48, 47, 49; 5/442, 444; 206/69, 62, 56, 76; 150/3; 269/328

[56] References Cited

U.S. PATENT DOCUMENTS 3,500,995 3/1970 Forman .
3,523,378 8/1970 Mitchell et al. .
3,720,367 3/1973 Rayner et al. ..... 229/62

FOREIGN PATENT DOCUMENTS 2062956 7/1971 France ..... 156/251

*Primary Examiner*—Edward C. Kimlin
*Assistant Examiner*—Timothy W. Heitbrink
*Attorney, Agent, or Firm*—Pollock, Vande Sande & Priddy

[57] ABSTRACT

A cover (36) is disclosed for use on the stirrups (12, 14) of a physician's examination table (10), to provide cushioned, comfortable surfaces against which the patient's feet rest during examination. Two layers (38, 42) of polymeric foam are joined to form a pocket (56) which slips over the stirrup from the top side (18) thereof. The exterior side (38) of the pocket which faces the examination table includes an upstanding wall (58) of foam material which cushions and protects the patient's heel from contact with bottom side (24, 26) of the stirrup. A method of making such a cover also is disclosed.

2 Claims, 8 Drawing Figures

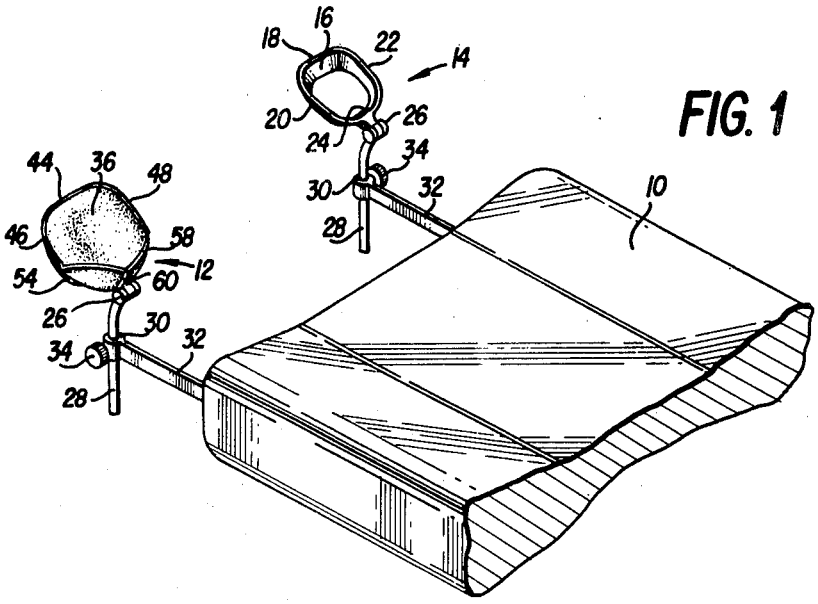
FIG. 1
FIG. 7
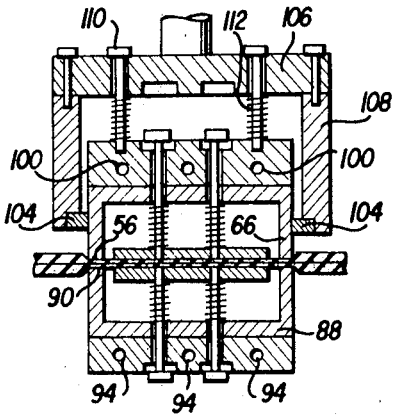
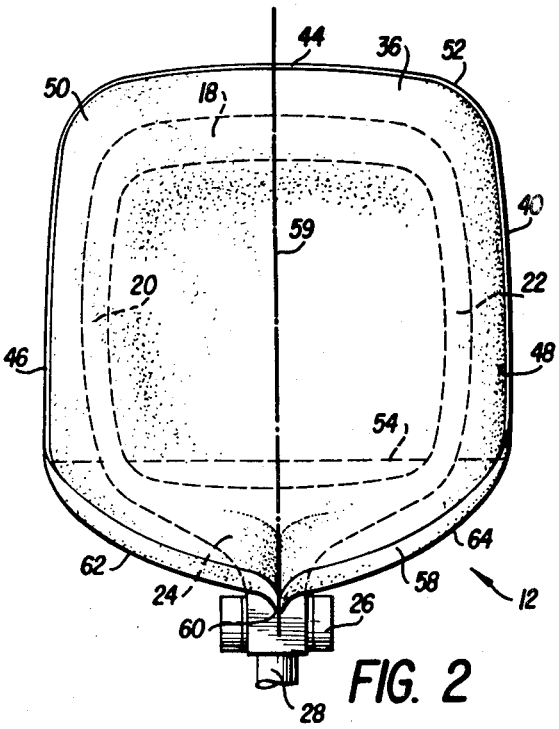
FIG. 2
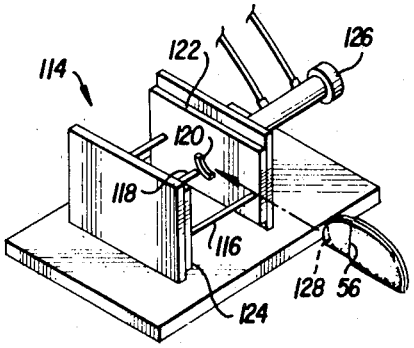
FIG. 8

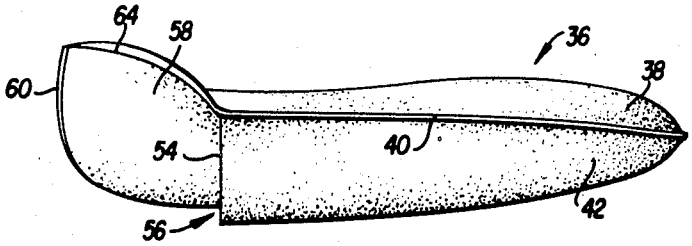
FIG. 3
FIG. 4
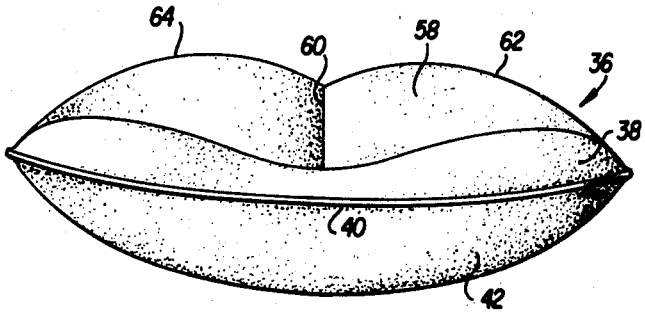
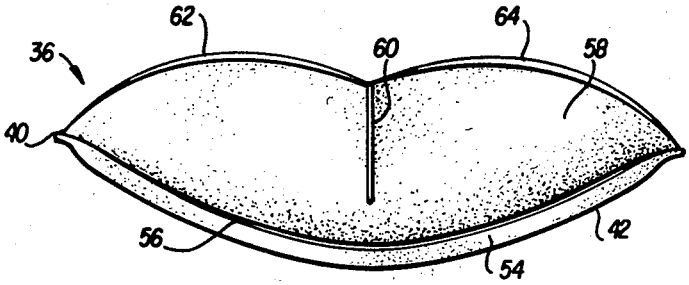
FIG. 5
FIG. 6
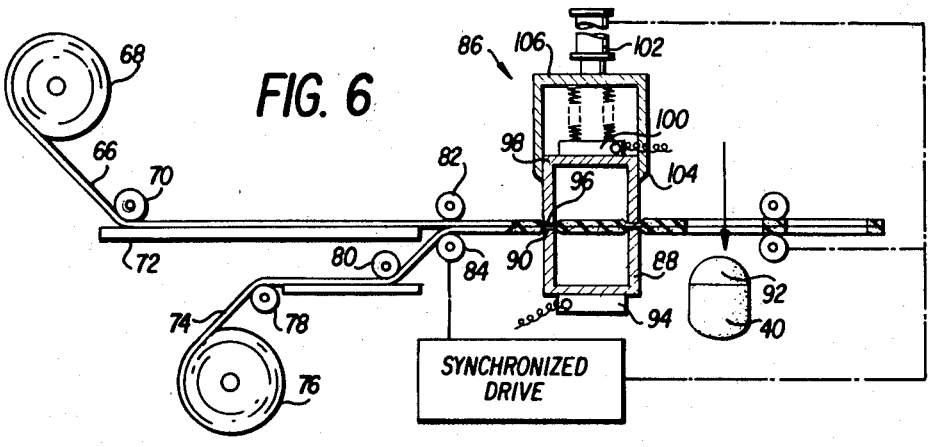

METHOD OF MANUFACTURING COVER FOR STIRRUP OF PHYSICIAN'S EXAMINATION TABLE

This is a division of application Ser. No. 159,974, filed June 16, 1980, now U.S. Pat. No. 4,360,193.

TECHNICAL FIELD

The invention relates generally to sanitary protective coverings of the type commonly used in physicians' offices to provide a clean, cushioned surface against which the patient's body or portions of it may rest during examination or treatment. More particularly, the invention concerns a type of padded cover for use on the conventional stirrups found on most physicians' examination tables, and a method of making such a cover from elastomeric foam material.

BACKGROUND ART

For decades, most physicians' examination tables have included a pair of adjustable supports, known as stirrups from their resemblance to the common article of horse riding tack identified by the same name, which are especially useful to support the patient's feet and legs in an elevated, separated position so that various examinations and treatments may be performed. Because the weight of much of the patient's legs is supported in this fashion and because in some instances the patient may apply force against the stirrups, prolonged use may tend to be rather uncomfortable due to the typically small contact area afforded by the stirrup for the foot. In addition, since the stirrups usually are made from metal, they tend to be rather cold to touch, which can provide an additional measure of discomfort for the patient.

Numerous attempts have been made to alleviate these problems. In some instances, it may be permissible for the patient's shoes to remain in place when the feet are placed in the stirrups. However, for sanitary reasons this may not be desirable in many cases. Physicians have known to place ordinary socks over the stirrups to improve the level of comfort. In another prior art device, a padded, mitten-like cover was provided which slipped over or around the stirrup and was secured by means such as a drawstring, zipper or hook-and-pile fastener. Another known stirrup guard comrpised a flat annular blank of padded material such as foam plastic which was secured to the stirrup by several tie-strings.

While these prior art solutions have achieved a measure of success, a need has continued to exist for an inexpensive, simple cover for the stirrups which would be pleasing in appearance and easy to install without the need to secure any fasteners, and yet would provide adequate cushioning and thermal insulation for the patient's feet.

DISCLOSURE OF THE INVENTION

A primary object of the present invention is to provide an inexpensive, cushioned cover for the stirrups of physicians' examination tables.

A further object is to provide such a cover which can be easily slipped over the stirrup and does not require the use of other fasteners.

Yet another object of the invention is to provide such a cover which is attractive in appearance when installed on a stirrup.

Still another object of the invention is to provide such a cover which can be made from polymeric foam sheet material.

A still further object of the invention is to provide a method of making such covers which is economical and reliable for high volume production.

These objects are given only by way of example. Thus, other desirable objectives and advantages inherently achieved by the invention may become apparent to those skilled in the art. Nonetheless, the scope of the invention is to be limited only by the appended claims.

The cover according to the present invention preferably is made from an elastomeric sheet material which can be joined to itself or other similar materials by sewing, cementing, induction sealing, thermal sealing and similar techniques. By "elastomeric material" is meant any material, natural or synthetic, which is characterized by flexibility and stretchiness. One preferred example of such a material is open-celled polyurethane foam, a common synthetic material which may be produced by blowing a polyester resin with a diisocyanate compound. Such materials are commercially available in the sheet form preferred for the invention and are particularly suited for the various methods of joinder described in U.S. Pats. Nos. 3,238,079 and 3,638,262, the disclosures of which are hereby incorporated by reference.

A preferred embodiment of the cover for a stirrup according to the invention comprises a pair of sheet elements of elastomeric material which are joined to each other to define a pocket between the two. The pocket is open at one end and sized so as to receive at least a portion of the top element and at least a portion of the two side elements of a conventional stirrup of a medical examination table. The one of the sheet elements which faces toward the examination table during use is provided with a curved, upstanding wall means extending from its surface which cushions and protects the heel of the patient against contact with the bottom element of the stirrup. Thus, when the instep of the foot bears on the top element of the stirrup and the ball of the heel tends to extend into the central opening of the stirrup, the surfaces of the stirrup facing the patient are covered and cushioned.

The elastomeric material used in the invention is heat sealable so that the two sheet elements may be joined by a heat seal extending around the perimeter of the pocket to the sides of the mouth of the pocket. The heel cushioning and protecting means may be formed by upstanding portions of the sheet element facing the examination table, which are joined together at a central seam to form a curved wall which extends around the back of the patient's heel when the foot is resting in a stirrup enclosed within a cover according to the invention.

In accordance with the method of making a cover according to the invention, two bands of different widths of elastomeric material are placed one on top of the other, or face-to-face, and conveyed into a heat sealing press. Or, a single band may be folded to provide regions of single and double thickness. In the press, the wide and narrow bands are heat sealed to each other to define most of the perimeter of the stirrup-receiving pocket previously mentioned, one edge of the narrow band defining the open edge or mouth of the pocket. Other methods of uniting the material also may be used, as indicated previously. The wide band is cut by thermal or other techniques to form a flap which extends axially beyond the pocket and has a generally semicircular configuration. The assembly of pocket and flap is then removed from the bands and at least the flap is folded longitudinally. A short, curved heat seal is then made from the end of the flap toward its centerfold so that a portion of the flap may be removed after heat sealing. When the assembly of pocket and flap then is unfolded, the flap and curved heat seal form the heel cushioning and protecting means which extends essentially sideways from the opening of the pocket.

BRIEF DESCRIPTION OF THE DRAWINGS

FIG. 1 shows a perspective view of the foot end of a conventional physician's examination table, including the usual foot-supporting stirrups, the lefthand one of which is enclosed within a cover according to the present invention.

FIG. 2 shows, partly in phantom, a view of the lefthand stirrup and the upper surface of the cover illustrated in FIG. 1, essentially as they would appear to a patient seated on the examination table.

FIG. 3 shows a side view of a stirrup cover according to the invention.

FIG. 4 shows a front end view of a stirrup cover according to the invention.

FIG. 5 shows a back end view of a stirrup cover according to the invention.

FIG. 6 shows a schematic view of an apparatus used in making a stirrup cover according to the invention.

FIG. 7 shows an enlarged view of the heat sealing press used in the apparatus of FIG. 6.

FIG. 8 shows a perspective view of a heat sealing apparatus used to form the curved seam at the back of the heel cushioning and protecting means according to the invention.

BEST MODE FOR CARRYING OUT THE INVENTION

The following is a detailed description of a preferred embodiment of the invention, reference being made to the drawings in which like reference numerals identify like elements of structure in each of the several Figures.

FIG. 1 is a fragmentary, perspective view of the foot end of a conventional medical examination table 10 which includes a pair of conventional, adjustable stirrups 12, 14. Each stirrup or foot support includes an open brace or frame 16 of roughly four-sided configuration, having a top element or crossbar 18, a pair of side elements or bars 20, 22 and a bottom element or yoke 24. An adjustable pivot 26 extends from yoke 24 to the upper end of a vertically adjustable rod 28. Each rod 28 is slidably mounted in a sleeve 30 attached to the end of a laterally extending support bar 32. A set screw 34 passes through sleeve 30 into contact with rod 28. Usually, the brace and associated supports are metal. Other brace or frame types are known in addition to that shown, and the stirrup cover according to the invention is considered to be useful on them as well. Although the stirrups are typically configured and adjusted so as to optimize the patient's comfort when the instep is placed against crossbar 18 and the heel extends into the opening of the frame, it can be appreciated that unless the patient wears shoes, maintaining prolonged contact with the stirrup can be quite uncomfortable.

A stirrup cover 36 according to the invention is shown installed on stirrup 12 in FIGS. 1 and 2 and removed from a stirrup in FIGS. 3 to 5. Cover 36 comprises an upper sheet element 38 of elastomeric material joined by a heat seal seam 40 to a lower sheet element 42 also of elastomeric material. As best seen in FIGS. 1 and 2, elements 38 and 42 each comprise an upper edge 44, essentially parallel side edges 46, 48 and curved upper corners 50, 52, all defined by heat seal seam 40. Lower element 42 terminates in a free edge 54 which defines one side of the mouth of a pocket 56 formed between the two sheet elements. Edge 54 need not be located so as to reside in use approximately at the level of yoke 24, as illustrated, but may also extend between edges 46, 48 below the level of the yoke or considerably above the level of the yoke. To ensure that cover 36 will remain on the stirrup in use, edge 54 preferably is located approximately 2 to 2.5 inches below upper edge 44 so that pocket 56 will be of sufficient depth to hold the cover in place on the stirrup. Depending on the particular stirrup geometry to be covered, other shapes may also be used for upper and lower sheet elements 38, 42; however, the shape should conform generally to the outline of the upper portion of the stirrup frame, for best results. The mouth of pocket 56 preferably is wide enough to pass the widest part of the upper end of the stirrup; however, if a tighter fit is desired at the lower end of the stirrup, the mouth may be made narrower, within limits, and still accommodate the stirrup due to the stretchiness of the material.

Upper sheet element 38 extends beyond the edge 54 of pocket 56 to form a flap which is provided with an upstanding, curved heel cushioning and protecting wall 58, formed by joining portions on either side of the center line 59 of upper sheet element 38 by means of a short curved heat seal seam 60 which extends upward from the center line. Thus, wall 58 extends essentially sideways relative to edge 54 and the opening of pocket 56, as seen best in FIG. 3. The upper edges 62, 64 of wall 58 preferably arch gently from seam 60 toward pocket seam 40; however, other edge configurations may be used without departing from the scope of the invention. The rather cupped, or curved configuration of cover 36 shown in FIGS. 1 to 5 results from the formation of wall 58 and seam 60 in the manner now to be described.

As shown in FIGS. 6 to 8, covers 36 preferably are made in a series heat sealing operations. A narrow strip or band 66 of elastomeric material is drawn from its storage roll 68 and advanced by rollers 70 along a support surface 72. At the same time, a wide band or strip 74 of elastomeric material is drawn from its storage roll 76 past guide rollers 78, 80 and is brought into face-to-face contact with band 66 at feed rollers 82, 84. Although both of bands 66, 74 are preferably of the same type of foam sheet previously mentioned, it will be understood by those skilled in the art that different types of heat sealable material could also be used without departing from the scope of the invention. The bands 66, 74 preferably are advanced incrementally into a cutting and sealing station 86. That is, their advancement occurs in a series of successive, left-to-right longitudinal movements, each movement being followed by a period in which the bands are stationary. Cutting and sealing station 86 functions each time the bands come to rest, resulting in the formation of a series of partially completed blanks for stirrup covers that are spaced from each other along the bands of material. Of course, other techniques for manufacturing the stirrup covers also may be used.

Cutting and sealing station 86 includes a stationary lower sealing die 88 having an upwardly disposed horizontal die face 90, which is configured to produce heat seal seam 40 between upper and lower sheet elements 38, 42 and to facilitate cutting upper element 38 with an essentially semi-circular flap 92 which extends axially beyond edge 54. Lower die 88 is provided with a heating element 94 by means of which it can be raised to the fusion temperature of the material of bands 66, 74. Directly above die face 90 and in registry therewith is a substantially identical downwardly disposed horizontal die face 96 of an upper sealing die 98, which is provided with heating element 100.

Upper die 98 reciprocates vertically under the influence of any suitable motor 102, is pressed into contact with bands 66, 74 each time they come to rest and is retracted before the material begins to move again. Thus, when bands 66, 74 are stationary, they are compressed between die faces 90, 96 for a time sufficient to form seal 40 and to soften the material at the edge of flap 92.

A shearing type cutter 104 is fitted closely about upper die 98. Because dies 88, 98 have vertical walls and meet in substantially perfect registry, cutter 104 can separate the material clenched between die faces 90, 96 from the rest of the bands lying outside the dies. As shown in more detail in FIG. 7, cutter 104 is generally in the shape of an inverted box which partially encloses upper die 98 and includes a base portion 106 attached to the motor 102. Side walls 108 depend from base 106 and a hardened cutting insert 104 is secured to the lower edge of said walls 108. Insert 104 conforms to the side walls of dies 88, 98 and surrounds the upper die. The upper die is suspended within the cutter assembly by means of bolts 110 which pass through holes in cutter base portion 106 and engage the upper die backing members. Springs 112 surround bolts 110 between base portion 106 and the upper die backing members.

The dies, when open, have sufficient clearance to permit the full thickness of bands 66, 74 to pass between them. The downward stroke of motor 102 exceeds this clearance to the extent necessary to drive cutter insert 104 at least partially past the upper surface of die 88, thereby severing a cover blank along seam 40 and the periphery of flap 92. However, since springs 112 are between cutter base 106 and the upper die backing members, upper die 98 must come to rest and springs 112 must be compressed before cutter insert 104 moves past the upper surface of die 88.

When the dies close, seam 40 is formed by coalescence of the material of bands 66, 74 caught between the dies and the perimeter of flap 92 is softened sufficiently to permit cutter insert 104 to sever it from band 74. As cutter insert 104 is moved downwardly, it severs all material within the die assembly from the remainder of bands 66, 74 outside the die assembly. The upper die is then retracted by motor 102 and bands 66, 74 are advanced. A completed blank for a stirrup cover is then separated from the rest of the bands, as shown in FIG. 6. The process is then repeated.

The blank produced in accordance with the process described with reference to FIGS. 6 and 7 is then folded by hand along its longitudinal axis so that edges 46, 48 are in registry with each other. Preferably, this fold is accomplished so that edge 54 remains on the outside of the folded blank, as shown in FIG. 8. The folded blank is then moved by hand in the direction of the arrow in FIG. 8 into a sealing and cutting mechanism 114. Guide rods 116, 118 enable the operator to quickly and accurately position the folded blank in the cutting and sealing station. A curved cutting and sealing die 120 is mounted on a plate 122 in registry with a similarly formed die (not shown) mounted on a plate 124. After the operator has inserted the folded blank into cutting and sealing station 114, a hydraulic ram 126 is activated by suitable controls, not illustrated, to move plate 122 laterally on guide rods 116 and 118 into contact and registration with the mating die surface on plate 124. Die 120 and the corresponding die on plate 124 crush portions of folded flap 92 along the dotted line 128 shown in FIG. 8. Die plates 122 and 124 are heated by any suitable means, not illustrated, so that short curved seam 60 is formed from the curved edge of the folded flap 92 downward to the centerfold line. The small triangular portion of flap 92 below seam 60 may be pulled off easily when ram 126 retracts and the completed stirrup cover is removed. When the cover is unfolded to the configuration shown in FIGS. 3 to 5, heel cushioning and protecting wall 58 rises to its illustrated position and the cover assumes its illustrated, rather concave shape.

Those skilled in the art will understand that the overall perimetral configuration of a stirrup cover according to the invention may be modified as necessary to accommodate stirrups of the various geometries now in use, without departing from the scope of the present invention. In one actual embodiment of the invention, the laid-flat dimensions of sheet element 38 were approximately 5.75 inches long and 5.0 inches wide, with corners 50, 52 having approximately a 1.0 inch radius. Sheet element 42, on the other hand, was only about 3.75 inches long, so that flap 92 extended about 2.0 inches beyond edge 54 of pocket 56, prior to formation of seam 60 and heel cushioning and protecting wall 58. Seam 60 subtended an arc of approximately 45° C. in the folded blank, measured upward from the centerfold. The elastomeric material used was polyurethane foam of approximately 0.3 inch thickness.

Having described my invention in sufficient detail to enable those skilled in the art to make and use it, I claim:

1. A method of making a cover for a stirrup of a medical examination table, comprising the steps of:

advancing a first band of elastomeric sheet material and a substantially wider second band of elastomeric sheet material into a face-to-face relationship;

uniting said bands in a first bonding operation to form therebetween a pocket having an open mouth with an edge defined by an edge of said first band, said pocket being of a width and depth sufficient to accommodate at least the upper portion of a stirrup;

cutting the material of said second band to form a flap extending beyond said edge of said open mouth, said flap and said pocket having a longitudinal axis which extends from the bottom of said pocket past said open mouth and along said flap;

separating said flap and said pocket from said bands; folding at least a portion of said flap along said axis so that said edge of said open mouth is at the exterior surface of the folded article; and forming a heel cushioning and protecting portion in said flap in a second bonding operation by uniting said folded portion in a curved seam extending upwardly from said axis.

2. A method according to claim 1, wherein said bonding operations are achieved by heat sealing.

* * * * *